US006787689B1

(12) United States Patent
Chen

(10) Patent No.: US 6,787,689 B1
(45) Date of Patent: Sep. 7, 2004

(54) FAST BEAT COUNTER WITH STABILITY ENHANCEMENT

(75) Inventor: Fang-Chu Chen, Taipei (TW)

(73) Assignee: Industrial Technology Research Institute Computer & Communication Research Laboratories, Hsinchu (TW)

( * ) Notice: Subject to any disclaimer, the term of this patent is extended or adjusted under 35 U.S.C. 154(b) by 0 days.

(21) Appl. No.: 09/283,872

(22) Filed: Apr. 1, 1999

(51) Int. Cl.[7] ..... G10H 7/08
(52) U.S. Cl. ..... 84/600; 84/603; 84/611
(58) Field of Search ..... 84/600–609, 611

(56) References Cited

U.S. PATENT DOCUMENTS 5,256,832 A * 10/1993 Miyake ..... 84/636
5,614,687 A * 3/1997 Yamada et al. ..... 84/662
6,343,055 B1 * 1/2002 Ema et al. ..... 369/53.16

OTHER PUBLICATIONS

Eric D. Scheirer, "Tempo and beat analysis of acoustic musical signals." 1996. MIT Media Laboratory, Cambridge, MA. pp. 588–601.*

Eric D. Scheirer, "Tempo and Beat Analysis of Acoustic Musical Signals", J. Acoust. Soc. Am. 103, pp. 588–601, Jan. 1998.

Judith C. Brown, "Determination of the Meter of Musical Scores By Autocorrelation", J. Acoust. Soc. Am. 94, pp. 1953–1957, Oct. 1993.

Edward W. Large & J hn F. Kolen, "Res nance and the Perception of Musical M t r", C nnection Science, vol. 6, Nos. 2 & 3, 1994, pp. 177–208.

* cited by examiner

*Primary Examiner*—Marlon T. Fletcher
*Assistant Examiner*—David S. Warren
(74) *Attorney, Agent, or Firm*—Stevens, Davis, Miller & Mosher, LLP

(57) ABSTRACT

A real time, multi-function beat counting system used in machine perception of musical rhythms employs a high speed stable algorithm including down sampling and group summing of the original signal, pulse matching on peak points, and check-frame decision making. The down sampled and group summed signal is utilized to derive an onset peak train formed of a series of data points. The onset peak train is divided into frames, and a threshold value is determined for each frame. In each frame, peak profiles are determined, each comprising successive data points within the frame having values greater than the threshold value. Within each peak profile, a peak point is identified. An algorithm is employed to compare the onset peak train with a plurality of unit data pulse sequences having different periods, and a match is determined between the onset peak train and the closest one of the unit data pulse sequences to identify the period of the rhythm.

10 Claims, 10 Drawing Sheets

FAST BEAT COUNTER WITH STABILITY ENHANCEMENT

BACKGROUND OF THE INVENTION

1. Field of the Invention

This invention relates to a system for computerized determination of rhythmic beat from a musical excerpt, which is particularly useful in music playback systems such as "disc jockey" (DJ) equipment.

2. Discussion of the Related Art

Advances in high performance state-of-the-art digital signal processors (DSPs) have led to much research into training machines to listen and respond in the same manner as human listeners to music compositions. Beat counting has been an active research topic among engineering and music societies. This interest derives from the fact that beat counting provides a basis for automatic music transcription and adds dynamics to music playback systems such as DJ equipment. A good beat counting algorithm, upon which DSPs base their patterns, must be capable of extracting relevant beat information from the music and providing a digital output representing the beat which corresponds to that which would be perceived by a human musician.

Human listeners have little problem feeling the beat of most music excerpts. Information, derived from the temporal changes of pitch and timber, words, and the presence of drumbeats, provides adequate cues easily discerned by the ears and brains of listeners. On the other hand, computers or DSPs cannot perceive such information without the application of complex processing techniques such as pitch extraction, speech recognition, and pattern matching. Even where these techniques can be implemented, they provide incomplete solutions. For example, pitch tracking is successful only on monophonic music; it fails otherwise. The same limitation exists for systems which track changes in timber and words. Also, drum beat tracking is ineffective with respect to music pieces having no drums.

One improvement on the above systems is to treat all the above factors equally and to attempt to detect a consistent "change pattern" based on an assumption that most changes, which indicate the presence of beats, appear in music signals as onsets of energy modulation. With this technique, the beat counting, usually a cognition problem, is primarily based on onset searching and pattern matching in signal processing systems. With regard to processing of acoustical signals, a straightforward method of onset searching or detecting employs the "edge detection" technique commonly used in image processing systems. However, with the necessary high sampling rate and long beat period (on the order of a few hundred milliseconds), direct edge detecting is very time consuming. A filter bank implementation for reducing the computational complexity has been proposed by E. D. Scheirer in his article "Tempo and Beat Analysis of Acoustic Musical Signals," J. Acoust. Soc. Am. 103, 588, 1998 (incorporated by reference herein in its entirety). This method utilizes several filters to split the signal into different subbands and applies down sampling to reduce the total number of points needed for computation. Disadvantages are that filtering is itself time consuming and the subsequent processes must be carried out repeatedly for each band. Therefore, only modest reductions in processing requirements are achieved. While it has been demonstrated that the entire Scheirer algorithm is sufficiently fast to run within the computation time of, for example, a Digital Equipment Corporation Alpha 3000™, it is a tight fit. With greater functionality being demanded by the DJ market, a tight-fit real time algorithm is not adequate. An efficient beat counting algorithm should be capable of running in real time on a less powerful DSP, along with other tasks.

Edge detection generates a train of pulses coinciding with the locations of the onsets in the original acoustic signal. Based on this pulse train, a beat counter operates to determine the frequency of the pulse occurrences. There has been much research addressing this issue from the point of view of psychology and digital signal processing. Among the published algorithms are the autocorrelation algorithm and the resonator phase-locking algorithm.

The autocorrelation method is implied (although not directly used in beat counting) in an article by J. C. Brown, "Determination of the Meter of Musical Scores by Autocorrelation," J. Acoust. Soc. Am. 94, 1993 (incorporated by reference herein in its entirety). The concept underlying this method is the same as that used by a pitch extractor, except that the beat period is considered longer. The autocorrelation coefficients of the pulse train signal are calculated, and the lag associated with the greatest coefficient is considered the beat period.

The resonator phase-locking method was first presented by E. Large, et al., "Resonance and the Perception of Musical Meter," Connection Science 6, 177, 1994 (incorporated by reference herein in its entirety). The concept underlying this technique derives from the Helmholtz resonators which have been used to determine the frequency of analog acoustic signals. The method passes the train of pulses coinciding with the onsets of energy modulation through each resonator of a set of digital resonators with different resonant frequencies. The resonator having maximum energy output is detected, and the frequency of the pulse train is determined by the resonant frequency of this resonator.

Both the autocorrelation and resonator phase-locking methods generate results whose accuracy depends on the parameter settings. A disadvantage of both methods is the computational complexity and cost. Moreover, none of the above methods has adequately addressed concerns with the stability of the beat counter when experiencing an abnormal rhythm change. In this regard, the only proposed solution has been to slow down the responding time, while averaging the result over a long time interval. This proposal has not produced good results. As a result of these problems, the above methods have been very limited in application.

As noted above, music playback systems such as DJ equipment require good performance and low costs. The cost of an algorithm is determined by memory requirements and, more importantly, computational complexity. As discussed above, "real time" is no longer a sufficient condition; because DJ audio equipment performs more than one function at a time (such as simultaneously performing beat counting and sound-effect-changing), a speed much faster than real time is needed. There is no foreseeable limit on how fast the algorithm should be.

SUMMARY OF THE INVENTION

It is an object of the present invention to provide a novel beat-counting algorithm with a high computation speed which is significantly faster than real time and which can be employed on such apparatus as DJ equipment, CD players and audio effect boxes and with automatic music transcription software.

It is another object of the present invention to provide a novel beat-counting system having the capability of reporting stabilized results. This feature is enabled by the present invention because of the fast speed of the algorithm which gives time for additional decision-making steps to be carried out before a BPM (beats per minute) decision is reported.

It is yet another object of the present invention to provide a novel beat-counting system which has the capability of operating on an acoustical signal rather than a MIDI (musical instrument digital interface) signal.

The algorithm according to the present invention is summarized as follows. An onset searching/pattern matching structure is employed with an efficient and reliable group-summing method that is conducted as a preprocessing step to reduce the sample points. The beat frequency searching algorithm is simplified based on a novel analogy with the beat perception mechanism of the human mind and ears. After a BPM is generated, a stability enhancement method is used to decide whether the BPM needs to be updated.

The goal of the algorithm of the present invention is to provide a beat counter which can be mounted on a CD player or an effect box for displaying beat count in real time. The algorithm includes five basic steps: down sampling, group summing, onset detecting, beat counting, and stability enhancing.

According to one aspect of the invention, there is provided a method of determining a rhythmic beat of a digital sound signal, comprising the steps of (a) down sampling the digital signal by a predetermined factor to produce a decimated signal comprising a plurality of first data points; (b) grouping the plurality of first data points into groups each comprising a predetermined number of the first data points of the decimated signal and summing absolute values of the data points in each of the groups to produce a group-summed signal comprising a plurality of second data points; (c) dividing the plurality of second data points of the onset peak train into a plurality of successive frames of uniform duration; (d) determining for each of the frames a threshold value and detecting, within each of the frames, peak profiles each comprising successive ones of the second data points having values greater than the threshold value; (e) detecting, within each of the peak profiles, a peak point having a greatest value among the successive ones of the second data points; and (f) determining a match between (i) the peak point and ones of the second data points located at least one of before and after the peak point and (ii) one of a plurality of unit data pulse sequences, having different periods, in accordance with an algorithm, wherein the rhythmic beat is determined to correspond to the period of the one of the unit pulse sequences.

The threshold value may be defined by a relation (A+M)/2, where A is the average of the values of all of the second data points within one of the frames and M is the maximum of the values of all of the second data points within the one of the frames. Step (f) can comprise (i) calculating a function $$\mathrm{Sum}_i(n)=x(M)+x(M+n)+x(M+2n)+\ldots+x(M-n)+x(M-2n)$$

where, for the first one of the frames, x is a signal representing the onset peak train, i is a selected peak point index, M is a peak point position, and n is a period of the unit pulse sequences, where n ranges from a first integer number to a second integer number, (ii) calculating $\mathrm{Sum}(n)=\Sigma_i\mathrm{Sum}_i(n)$, and (iii) determining a value of n=N resulting in a greatest sum $\mathrm{Sum}(n)=\Sigma_i\mathrm{Sum}_i(n)$, wherein the match is determined to exist with the one of the unit pulse sequences having a pulse period equal to N, and the rhythmic beat is determined to correspond to period N. The method may further comprise a check frame decision step (g) comprising: (i) with respect to a second frame of the plurality of successive frames which immediately succeeds the first one of the frames, performing a check frame decision processing by calculating a function $\mathrm{Sum}_i(n)=x(M)+x(M+n)+x(M+2n)+\ldots+x(M-n)+x(M-2n)$, where, for the second frame, x is a signal representing the onset peak train, i is a selected peak point index, M is a peak point position, and n is a period of the unit pulse sequences, where n ranges from n=N−L to n=N+L, where L is an integer number which is less that the difference between the first and second integer numbers, calculating $\mathrm{Sum}(n)=\Sigma_i\mathrm{Sum}_i(n)$ and determining whether N yields a peak in Sum(n) for the check frame processing of the second frame; (ii) if step (g)(i) determines that N yields the peak in Sum(n) for the check frame processing of the second frame, the rhythmic beat for the first frame and for the second frame is determined to correspond to period N and a third frame immediately succeeding the second frame is processed in accordance with step (g)(i), and (iii) if step (g)(i) determines that N does not yield the peak in Sum(n), the rhythmic beat for the second frame is determined to correspond to period N and the third frame is processed in accordance with step (g).

According to another aspect of the invention, there is provided an apparatus for determining a rhythmic beat of a digital sound signal, the apparatus comprising (a) decimation means for down sampling the digital signal by a predetermined factor to produce a decimated signal comprising a plurality of first data points; (b) group summation means for grouping the plurality of first data points into groups each comprising a predetermined number of the first data points of the decimated signal and summing absolute values of the data points in each of the groups to produce a group-summed signal comprising a plurality of second data points; (c) means for dividing the plurality of second data points of the onset peak train into a plurality of successive frames of uniform duration; (d) determination means for determining for each of the frames a threshold value and for detecting, within each of the frames, peak profiles each comprising successive ones of the second data points having values greater than the threshold value; (e) detection means for detecting, within each of the peak profiles, a peak point having a greatest value among the successive ones of the second data points; and (f) match detection means for determining a match between (i) the peak point and ones of the second data points located at least one of before and after the peak point and (ii) one of a plurality of unit data pulse sequences, having different periods, in accordance with an algorithm, wherein the rhythmic beat is determined to correspond to the period of the one of the unit pulse sequences. The apparatus of the invention can include the same refinements described above with respect to the method of the present invention.

BRIEF DESCRIPTION OF THE DRAWINGS

FIG. 2(*b*) shows the signal of FIG. 2(*a*) after down sampling and group summing.

FIG. 2(*c*) shows the signal of FIG. 2(*b*) after smoothing.

FIG. 2(*d*) shows the signal of FIG. 2(*c*) after differentiating.

FIG. 6(*b*) shows results of a BPM report while employing the stability enhancement method of the present invention.

DETAILED DESCRIPTION OF THE INVENTION

Figure 1:
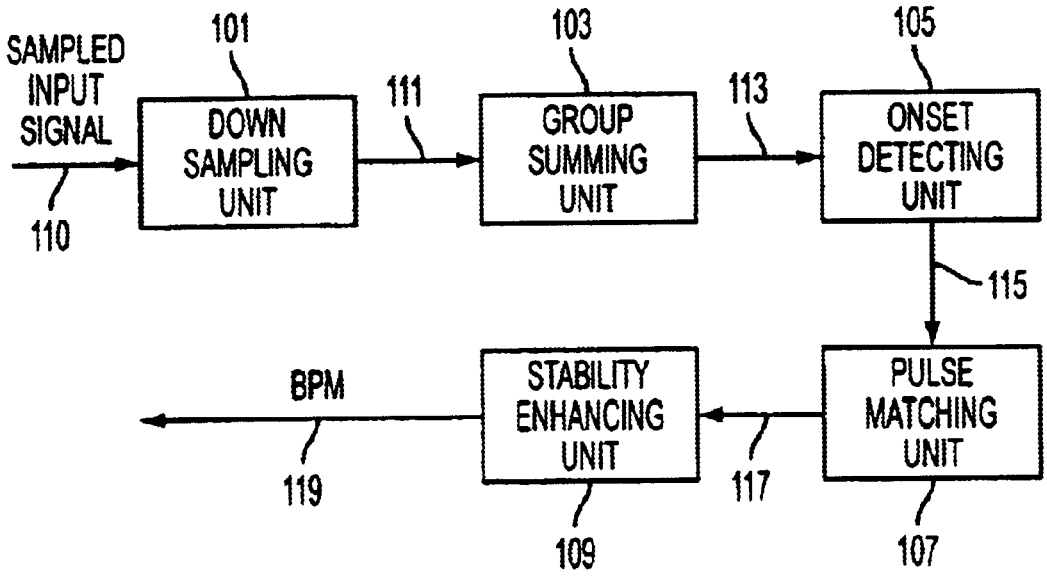
FIG. 1 is a block diagram of an illustrative embodiment of a beat counting apparatus of the present invention.
Figure 2A:
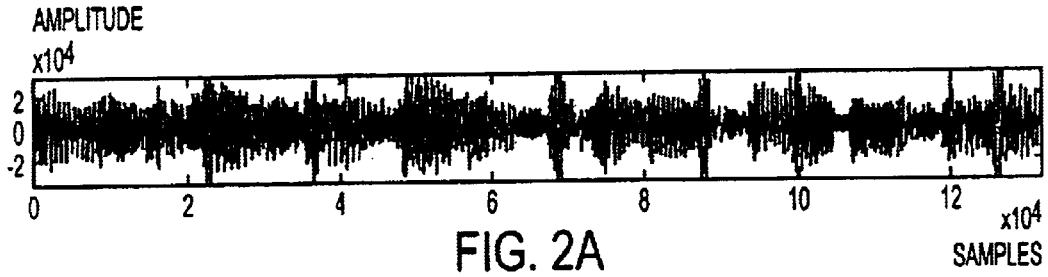
FIG. 2(*a*) shows an original acoustic signal.
Figure 2B:
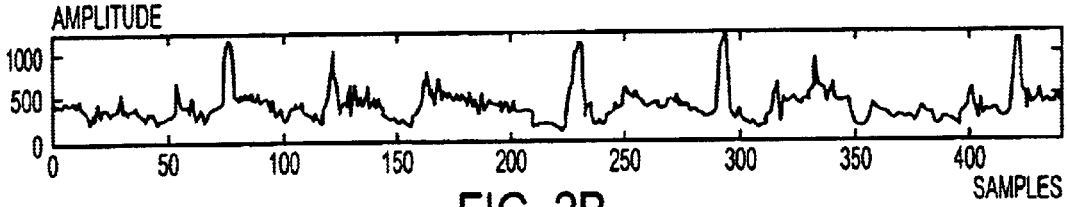
Figure 2C:
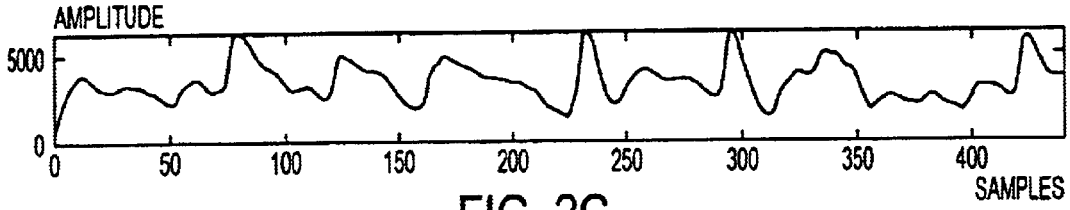
Figure 2D:
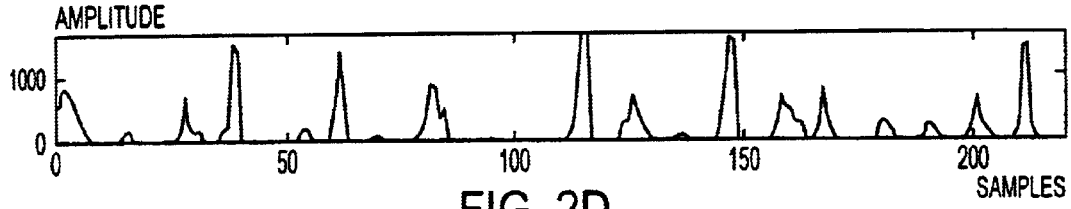

FIG. 1 is a block diagram of a beat counting apparatus of the present invention. The following provides an overview of the FIG. 1 apparatus; additional details will be provided in subsequent sections hereinbelow. In FIG. 1, a digitized acoustical signal comprising a sequence of digital data points or samples is input on line 110 to down-sampling unit 101 which down-samples the input digital signal by a factor of, for example, ten and provides a decimated signal on line 111. Group-summing unit 103 groups the data points of the decimated signal into groups of 30, for example, and forms a group sum of the absolute values of every 30 data points of the decimated signal and outputs the group-summed signal on line 113. Onset detecting unit 105 employs a smooth-and-differentiate processor and detects the onset peaks of energy modulation in the group-summed signal on line 113 and generates on line 115 a train of pulses, hereinafter called the onset peak train, which coincides with the onset peaks. The onset peak train is illustrated, for example, in FIG. 2(*d*) and in FIG. 3. Beat-counting unit 107 performs a pulse-matching process by comparing, in accordance with an algorithm described in detail below, the onset peak train on line 115 with a set of unit pulse sequences of different periods and determines the one of the unit pulse sequences that most closely matches the period of the onset peak train. From this period, the beats per minute (BPM) are calculated, and an output representing the BPM is provided on line 117. Stability enhancement unit 109 employs a check-frame decision making process on the BPM reported on line 117 and provides a stabilized BPM report on line 119.

A detailed discussion of the components of the FIG. 1 apparatus will now be provided.

1. Down-sampling Unit 101 and Group-summing Unit 103

Digital audio signals are usually sampled at 44.1 kHz. Direct processing of the signals would require tremendous computational power from the processor. However, with regard to beat perception, a large portion of the data carries unimportant information. Accordingly, retaining all of the details of the waveform is unnecessary. This is especially true when the signal will later be smoothed. The present invention employs two steps in reducing the data redundancy. First, the original signal is down sampled by a factor of ten, and second, every 30 data points are summed. These two steps effectively reduce the sampling rate to 147 Hz, i.e., by a factor of 300, and greatly reduce the computational load of the DSP. The justification for this is described below.

A major concern with regard to down sampling of a signal involves aliasing. However, the present invention recognizes that aliasing is not a real issue when there is no need to rely on the spectrum of the signal. It is the envelope of the waveform that matters for an onset detector. As long as the sampling rate can preserve the envelope and onsets of a waveform, it should be acceptable. Based on the assumption that the maximum beats per minute (BPM) are 180, which corresponds to three beats per second, a sampling rate of 147 Hz should suffice. However, directly down sampling the signal to 147 Hz poses a threat regarding the precision. First, some of the onsets might disappear with the 299 data points that are neglected. Secondly, the coarse temporal resolution of the signal waveform would degrade the performance of the onset detector. In order to tackle these problems, the present invention employs the aforementioned "group summing" method, which involves, rather than discarding data points, summing them up. In other words, after the 10:1 decimation of the original signal, the points are grouped into groups of 30, and each group is represented by the scaled sum of the absolute values of their members. This procedure turns out to be more than what it first seems. Because of the fact that group-summing performs data smoothing and, at the same time, preserves the peaks with width of the group dimension, it not only reduces sample points but also assists in onset detection. This can be seen from FIG. 2(*b*) where the onsets of the original signal have been redefined as prominent peaks after group summing. With this concise version of the signal (i.e., achieved after decimation and group-summing), the following calculation can be done in a much more efficient way than is the case with many other beat counter algorithms.

2. Onset Detection Unit 105

For certain strong-beat music pieces, the peaks formed by the down-sampling and group-summing units 101 and 103 described above provide sufficient information for beat counting without the need of onset detection. However, to ensure better quality and broader application, an onset detector 105 is incorporated into the beat-counting system of the present invention. This onset detector 105 is a smooth-and-differentiate processor which in itself is known to those skilled in the art and can be easily found in the existing literature (for example "Two-Dimensional Signal and Image Processing" by Jae S. Lim PTR PRENTICE HALL). The specific computation adopted in the algorithm of the present invention will now be briefly described. First, the group-summed signal is smoothed by a low pass filter which is 100 milliseconds long with a cutoff frequency at about 20 Hz (the filter is 7-tab when the sampling rate is 147 Hz). Then, the differentiation is performed as follows. The difference between every other sample point is calculated to extract the sharp transitions of the smoothed signal. The reason for taking the difference of every other point is to extract the sharp transitions of the smoothed signal and to make the peaks stand out more clearly by avoiding some fine fluctuation of the smoothed signal. Alternatively, since only half of the data in the smoothed signal is needed, the smoothed signal can be calculated for every other point while taking the straight difference. The second method saves the DSP half of the effort of computing the convolution between the signal and the filter. Finally, a rectifier is used to set to zero the data points whose values fall below zero. This is done under the assumption that onsets only concern the rising of the signal amplitude not the opposite. The results are shown in the graphs of FIGS. 2(*c*) and (*d*). The onset peaks of the onset peak train of FIG. 2(*d*), which suggest the beat locations, are then used for beat counting in beat counting unit 107 of FIG. 1.

3. Beat Counting Unit 107

Figure 3:
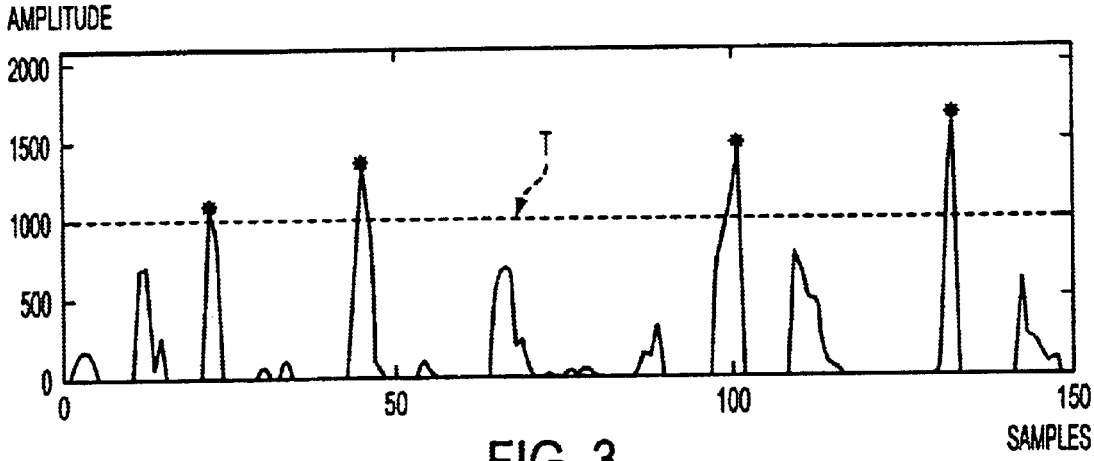
FIG. 3 shows an onset peak train derived by processing the signal of FIG. 2(*d*).

Beat counting unit 107 receives the onset peak train from onset peak detecting unit 105 and performs a pulse matching process to estimate the BPM as described below. The beat counting algorithm of the present invention, when compared with the resonator phase-locking technique, has a different approaching concept and different implementation. The theory of phase-locking is to liken the human beat perception system to a resonator, which, when properly tuned, can identify the frequency of a noise-affected periodic signal. A problem with this approach is that the resonator needs to process the whole input signal and monitor every single output data for some period in order to determine the waveform pattern and come up with a frequency number. This might be the way humans perceive pitch, but it is not exactly the way they achieve beat perception. It would be more natural to say that humans perceive rhythm by first locating an onset, looking back in their memory for recently perceived onsets, and then studying the regularity of the occurrences of the onsets. With regard to beat perception, the information between beats does not really contribute. With this in mind, the present invention employs a novel algorithm which ignores most of the unnecessary processes. This algorithm, as opposed to the autocorrelation and the resonator phase-locking algorithms which operate on every sample, processes only those data points which lie at the top of certain pulse peaks. In the present invention, these points are denominated "peak points" (FIG. 3). The techniques of the present invention for searching and pulse matching are implemented as described below.

Figure 4A:
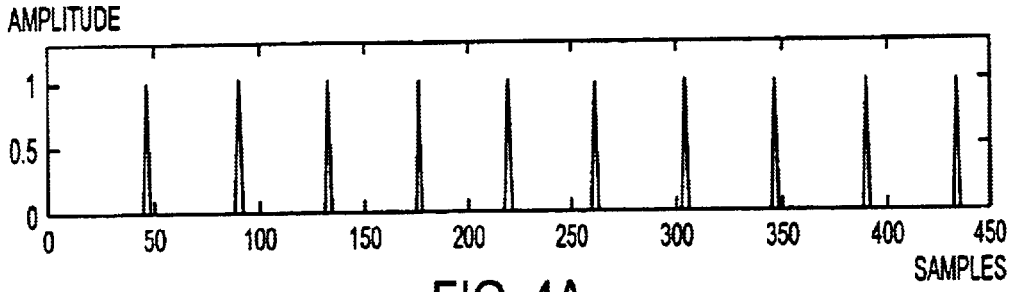
FIGS. 4(*a*) and 4(*c*) shows examples of unit pulse sequences for comparison with the onset peak train shown in FIG. 4(*b*).
Figure 4B:
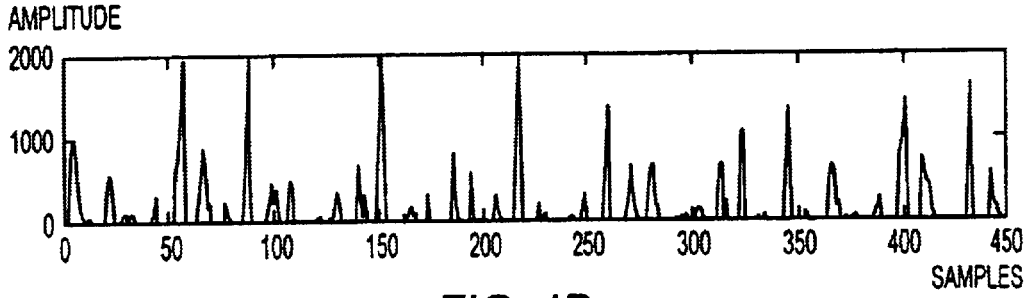
Figure 4C:
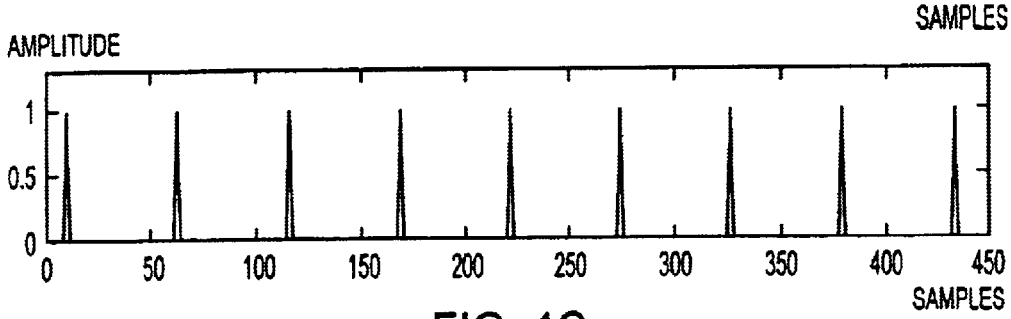

The onset peak train generated by the onset detector 105 is segmented into frames of about two seconds long. A peak profile is defined by those successive points inside a frame with values higher than a threshold T calculated as:

$$T=A+(M-A)/2=(A+M)/2$$

where A and M are, respectively, the average and the maximum of all data points within an onset peak train frame. In FIG. 3, the threshold T is indicated by the dashed line, and the peak points are indicated by the asterisks. The peak point is the data point with the greatest value in the peak profile. The pulse matching process is as follows. First, it is assumed that the peak point is at a beat position, and the onset peak train is compared with a set of unit pulse sequences of different periods. FIG. 4(*b*) shows an onset peak train, and FIGS. 4(*a*) and 4(*b*) show examples of unit pulse sequences. The period of the unit pulse sequence best matching the period of the onset peak train is selected as a candidate for the onset peak train period. The determination of the match is made mathematically as described below.

A function $\mathrm{Sum}_i(n)$ is calculated by adding the values of ten onset peak train data points matched by the unit pulses before and/or after the peak point. A match is defined as a coincidence in time. $\mathrm{Sum}_i(n)$ is expressed as:

$$\mathrm{Sum}_i(n)=x(M)+x(M+n)+x(M+2n)+\ldots+x(M-n)+x(M-2n) \quad (1)$$

where x is the onset peak train signal, i is the selected peak point index, M is the peak point position, and n is the unit pulse period, which ranges from 20 to 80 (which corresponds to BPM values 55 to 180). The inclusion of x(M) in the sum means that all unit pulse sequences must have at least one pulse right at the peak point i. If there exists a beat pattern matching a unit pulse sequence with period N, $\mathrm{Sum}_i(n)$ would show a maximum at unit pulse period n=N. Since there is certainly no guarantee that peak point i is really "on the beat," it is not sufficient merely to maximize $\mathrm{Sum}_i(n)$. Accordingly, the present invention includes the following further processing steps. $\mathrm{Sum}_i(n)$ is calculated for all peak points in the frame, and the values are accumulated to yield another function Sum(n), as defined in equation (2):

$$\mathrm{Sum}(n)=\Sigma_i\mathrm{Sum}_i(n) \quad (2)$$

The value N, which results in the greatest Sum(n), is determined to be the beat period in terms of the points of the onset peak train.

It should be noted that no matter how large n is, ten data points are always summed, expecting the beat pattern to repeat itself ten times. Also, when carrying out equation (1), a forward sum is performed first, i.e., adding up the data after M, until the frame boundary is reached, then a backward sum is performed, until ten data points have been added. The memory size, as a result, should be sufficiently large to store data points of previous frames for all n's. The amount of the memory buffer used in the process varies with the beat period, ranging from 200 (20×10) to 800 (80×10) points. This is quite natural because it resembles the way the human perception network works in that a longer time is required to set up the beat feeling for slow-paced music than for fast-paced music. It should be noted also that, as shown in FIG. 3, only four peak points are selected out of 150 points in the frame. If the logic of autocorrelation or resonator phase locking were followed, 30 times more computation would be needed for the task. Although FIG. 3 shows only one particular example, it is adequate to show how the present invention saves computation time. Moreover, due to the group-summing technique of the present invention, the memory size is comparatively smaller than what would be needed using a prior art technique.

Figure 5:
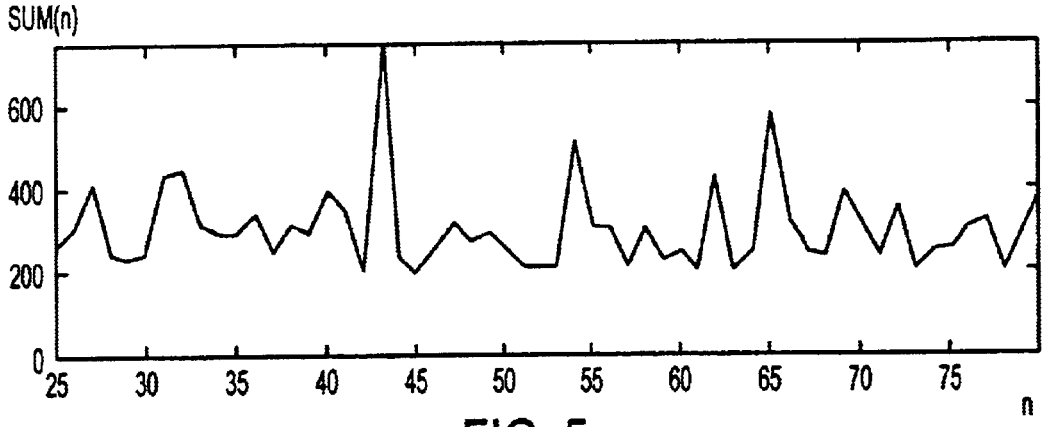
FIG. 5 shows a Sum(n) function of the onset peak train frame of FIG. 4(*b*).

FIG. 5 demonstrates one of the Sum(n) functions of the onset peak train frame in FIG. 3 and FIG. 4(*b*). Here, the best period (N=44) is successfully estimated by the highest peak. This period is related to the actual beat period by just a time factor resulting from sample reduction. After the beat period is determined, BPM can be calculated accordingly.

4. Stability Enhancement Unit 109

Stability enhancing unit 109 receives the BPM output from beat counting unit 107 and employs a check-frame decision making procedure to yield a stabilized BPM output on line 119. The beat counting system described above updates the values of BPM every frame, which is two seconds based on the value of the parameters chosen above. In each frame, the beat period is determined by the value of n which maximizes Sum(n) in equation (2). This is based on the theory that the period best coinciding with the onset peaks is the time duration of a quarter note. One possible scenario is that, for some time interval, the most frequently occurring note undergoes a change from a quarter note to another note, for example, an eighth note. As a result, the calculated period differs by, for example, a factor of two. If the change occurs over a short time period, the human's sense of beat will not be altered because of the integer-ratio-relationship of the two note values. However, the computerized beat counter would report a very different BPM value. This phenomenon, along with the actual presence of some short-term abnormal change of the beat pattern, results in some instability of the BPM reporting system. In order to improve the robustness of the beat counter, the present invention employs a method which allows the short-term fluctuation to be avoided without compromising the accuracy of beat calculation. This method will now be described in detail with reference to FIGS. 8(*a*) and 8(*b*).

First, the BPM value for a first frame 1 of a music piece is calculated using the novel beat-counting algorithm described in the previous sections. This BPM is assumed to be reported based on the duration of a quarter note just found. This frame is denominated a full-processed frame for the reason that the beat period, N, is determined by evaluating Sum(n) among all possible values of n ranging from 20 to 80 in the illustrative process described above, thus resulting in Sum(N) being a global maximum. As for the next frame, i.e., frame 2 in FIG. 8(*a*), which is tentatively denominated a check-frame, the process is simplified. Here, Sum(n) is evaluated only between n=N−10 and n=N+10. In other words, N is the beat period determined for frame 1; if, by way of example, N=44, Sum(n) for frame 2 would be evaluated only between n=34 and n=54, rather than n=20 and n=80 as with a full-processed frame. The purpose is to check if N still yields a peak in Sum(n) locally. The idea is that, even when the eighth note dominates in the current frame, the quarter note should still retain preference among its neighbors and present itself as a local maximum in Sum(n). As long as Sum(N) is a local maximum, BPM of the previous frame is reported for the current check-frame, and the next frame, i.e., frame 3 in FIG. 8(*a*), would still be a check-frame. If, on the other hand, Sum(N) is not a local maximum, BPM of the previous frame is reported for frame 2, but the next frame, i.e., frame 3 in FIG. 8(*a*), is set as a full-processed frame. It should be noted that BPM is only updated in a full-processed frame and never in a check-frame. If Sum(N) is not a maximum, this suggests that a dramatic change of the rhythm and a new BPM should be determined without the bounds of the previous results. If the change is short term compared with the frame size, the old BPM will report, and there is a greater confidence level in confirming that the pace of the music does change.

Figure 8A:
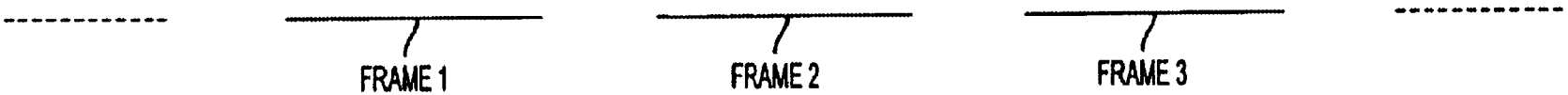
FIG. 8(*a*) is a schematic diagram showing three successive frames of an onset peak train, and FIG. 8(*b*) is a flow chart which illustrates the check-frame decision technique of the present invention applied to the three successive frames of FIG. 8(*a*).
Figure 8B:
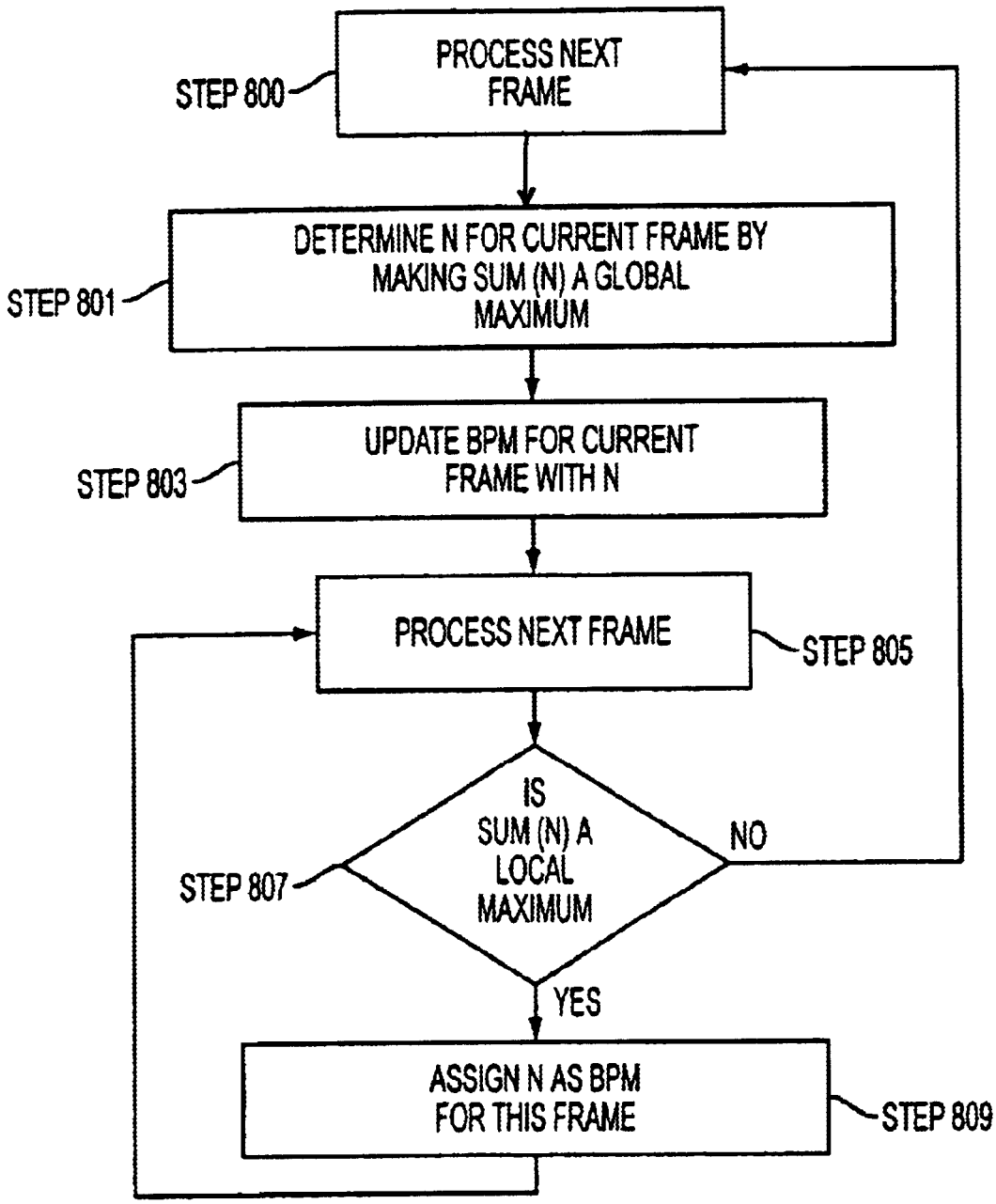

FIG. 8(*b*) is a flow chart illustrating the check-frame decision technique described above. Step 800 initiates processing of the "next" frame which, as it is being processed, is denominated the current frame. In step 801, the current frame (frame 1) is handled as a full-processed frame, and N for this frame is determined by making Sum(N) a global maximum. The BPM for this frame is updated in step 803 corresponding to beat period N. In step 805, processing of the next successive frame (frame 2), which is a check-frame, is begun, and in step 807, a determination is made as to whether Sum(N) is a local maximum for this frame. Regardless of whether the answer is yes or no, N is assigned to this frame (frame 2) since it is a check-frame, and the BPM is not updated for this frame. If step 807 determines that Sum(N) is a local maximum for this frame, the next frame (frame 3) is also treated as a check-frame. If step 807 determines that Sum(N) is not a local maximum, the next frame (frame 3) will be handled as a full-processed frame by proceeding to step 800. Steps 801–809 would then be carried out with respect to this frame (frame 3). It will be apparent that all frames of the onset peak train may be processed in this manner.

As can be seen, the decision making process employing the check-frame adds error resilience to the beat counter apparatus of the present invention. The only cost is the speed of the response to actual beat changes. As is apparent, the method must wait two frames to report a new value of BPM. With a frame two seconds long, it would seem that there will be a four seconds delay in response to the change. However, in actuality, no human being can foresee the beat change right at its beginning. Human beat perception has delays, too. Humans must wait to receive a couple of new beats to discern whether the beat pace has changed or not. The delay depends on the beat period which could be as long as two seconds if BPM is 60. As a result, the delay is not a problem. Moreover, even with regard to this "four seconds," there is a way to get around it when the algorithm is used on a CD player which has speed 2× or higher. With the high speed, the algorithm can actually "foresee" the future by utilizing the buffer; in other words, it can be fed with the data of the frame after the frame to which the DJ is currently listening. The actual situation would be such that, when the DJ is listening to a check-frame which suggests a new BPM, the algorithm is preparing to update the value before the DJ finishes that check frame. The delay can thus be cut to less than two seconds.

Figure 6A:
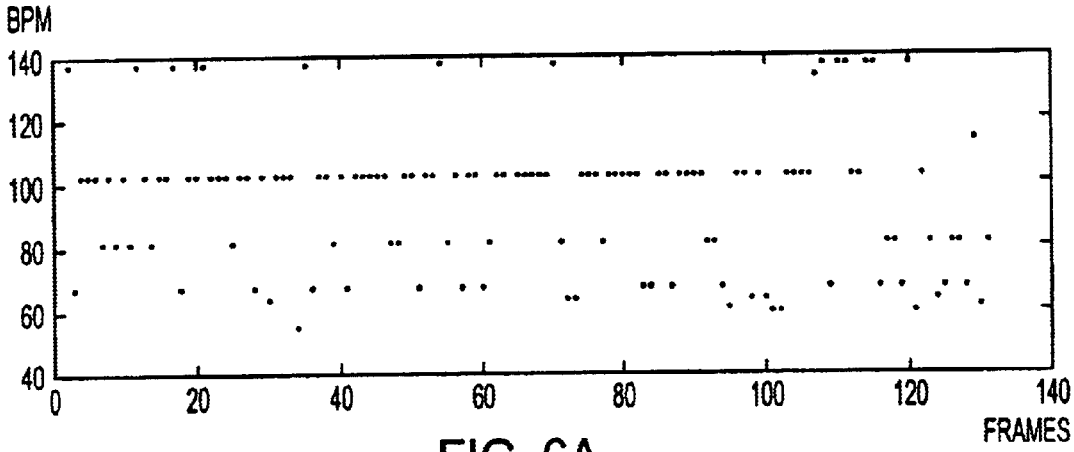
FIG. 6(*a*) shows results of a BPM report without employing the stability enhancement method of the present invention.
Figure 6B:
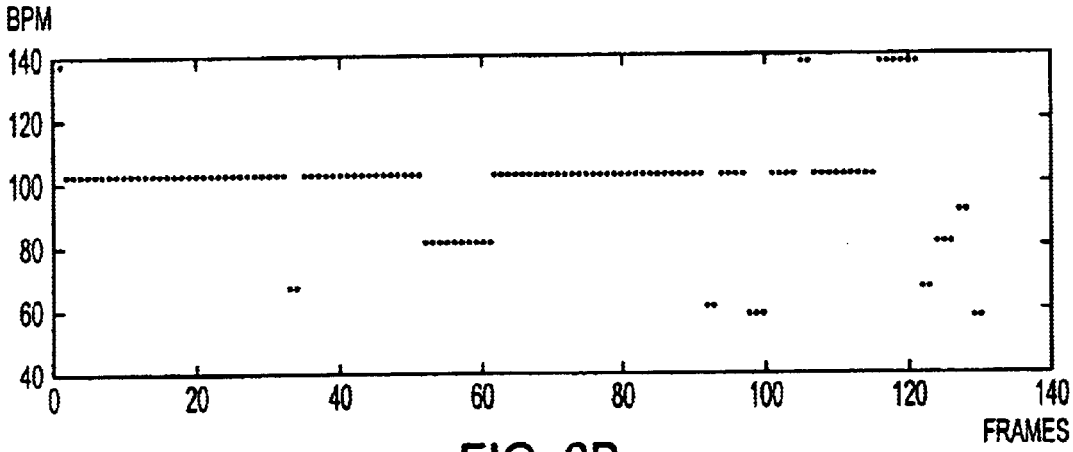

FIGS. 6(*a*) and (*b*) show the BPM values of a rock song (Semi-Charmed Life by Third Eye Blind) reported by the algorithm of the present invention with and without stability enhancement. It is apparent from FIGS. 6(*a*) and 6(*b*) that the check frame decision making greatly stabilizes the system. The BPM values reported without stability enhancement jump mostly among values having ratios close to those of two small integers, such as 2/3. This is due to the variability of music progressing rather than a real change of rhythm. A good beat counter should not be confused by this phenomenon.

Figure 7:
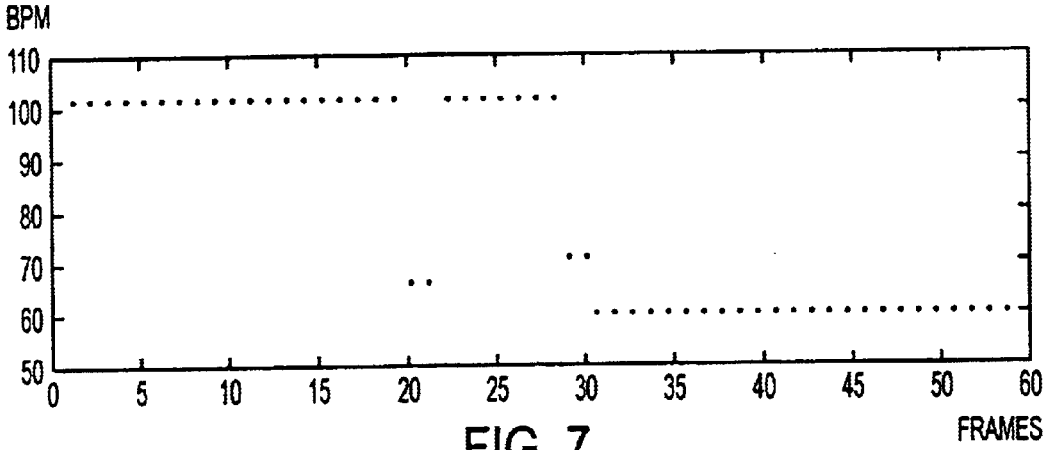
FIG. 7 shows BPM values for a two-minute sound file.

It should be noted that, by stabilizing the BPM reporting system, it is not blinded from detecting the real change. In fact, the system is capable of responding to a tempo change. FIG. 7 shows the BPM values for a two-minute sound file generated by manually pasting one sound sample to another using a waveform editor. The sound file has a sudden tempo change at about one minute into the file, estimated between the $27^{th}$ and $28^{th}$ frames in the graph. As can be seen, the system started its response at the $29^{th}$ value, although it seems to need a transition time before the new beat count is settled. This transition time is partly due to the requirement that ten data points should be added for Sum(n) and partly due to the imperfect connection between the two independent sound points. For the former, the transition time depends on the new tempo and should be shorter when the value is higher than 60 beats per second, the value for the second half in FIG. 7. As for the latter, it should not be a concern because it does not happen in a well-behaved music piece.

The performance of the computational speed is dramatic. It takes only eight seconds to process a 4.5-minute song. It should be noted that all the values of the parameters are changeable. For example, the parameters can be set so as to yield a beat counter with greater computational complexity yet shorter response time. However, with reasonable change, the fast speed is guaranteed, allowing simultaneous operations of beat-counting with other sound effects, and this is exactly what the DJ market needs.

Figure 9:
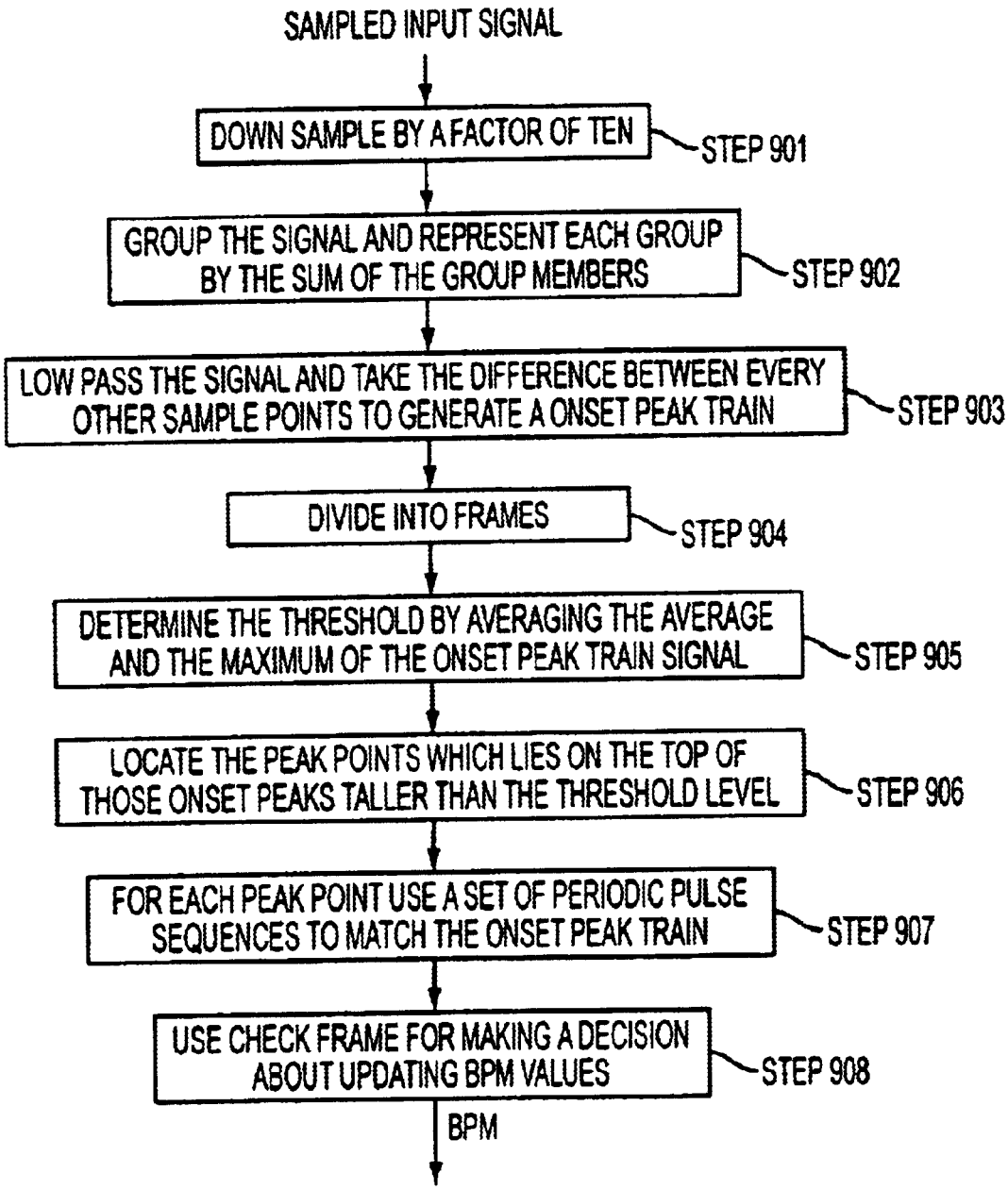
FIG. 9 is a flow chart of the beat counting system with stability enhancement according to the present invention.

FIG. 9 is a flow chart illustrating the overall system of the present invention. In Step 901, the input digital signal is down sampled by a predetermined factor (for example, ten) to produce a decimated signal comprising a plurality of first data points. In Step 902, the plurality of first data points are grouped into groups each of which comprise a predetermined number of the first data points (for example, 30) of the decimated signal and the absolute values of the data points in each of the groups are summed to produce a group-summed signal comprising a plurality of second data points. Step 903 includes deriving from the group-summed signal an onset peak train comprising a plurality of third data points in accordance with an algorithm which involves either setting the third data points to be identical to the second data points or processing the second data points in accordance with a smooth-and-differentiate algorithm to obtain the third data points. Step 904 includes dividing the plurality of third data points of the onset peak train into a plurality of frames of uniform duration, and Step 905 includes detecting, within each of the frames, peak profiles each comprising successive ones of the third data points having values greater than a predetermined threshold. Step 906 includes detecting, within each of the peak profiles of each of the frames, a peak point having a greatest value among the successive ones of the third data points. In Step 907, a match is determined between the peak point and one of a plurality of unit data pulse sequences, having different periods, in accordance with a predetermined criterion, wherein the rhythmic beat is determined corresponding to the period of the one of the unit pulse sequences. Step 908 includes performing a check frame decision making process as set forth in FIG. 8(*b*) in order to provide a stabilized output of the RPM.

It will be apparent to those of ordinary skill in the art that all the values of the parameters used in the detailed description of the present invention set forth herein may be modified to meet the requirements of any specific implementation. Moreover, although the present invention has been fully described by way of examples with reference to the accompanying drawings, it should be understood that numerous variations, modifications and substitutions, as well as rearrangements and combinations, of the preceding embodiments will be apparent to those skilled in the art without departing from the novel spirit and scope of this invention.

What is claimed is:

1. A method of determining a rhythmic beat of a digital sound signal, said method comprising:

(a) down sampling the digital signal by a predetermined factor to produce a decimated signal comprising a plurality of first data points;

(b) grouping said plurality of first data points into groups each comprising a predetermined number of said first data points of said decimated signal and summing absolute values of said data points in each of said groups to produce a group-summed signal comprising a plurality of second data points;

(c) dividing said plurality of second data points of said onset peak train into a plurality of successive frames of uniform duration;

(d) determining for each of said frames a threshold value and detecting, within each of said frames, peak profiles each comprising successive ones of said second data points having values greater than said threshold value;

(e) detecting, within each of said peak profiles, a peak point having a greatest value among said successive ones of said second data points; and (f) determining a match between (i) said peak point and ones of said second data points located at least one of before and after said peak point and (ii) one of a plurality of unit data pulse sequences, having different periods, in accordance with an algorithm, wherein said rhythmic beat is determined to correspond to the period of said one of said unit pulse sequences, wherein said threshold value is defined by a relation (A+M')/2, where A is the average of the values of all of said second data points within one of said frames and M' is the maximum of the values of all of said second data points within said one of said frames.

2. A method according to claim 1, further comprising, prior to step (c), processing said second data points in accordance with a smooth-and-differentiate algorithm.

3. A method according to claim 2, wherein said smooth-and-differentiate algorithm comprises a rectification step including setting to zero all of said second data points having values less than zero.

4. A method according to claim 1, wherein step (f) comprises calculating a function $$\mathrm{Sum}_i(n)=x(M)+x(M+n)+x(M+2n)+\ldots+x(M-n)+x(M-2n)$$

where, for said first one of said frames, x is a signal representing the onset peak train, i is a selected peak point index, M is a peak point position, and n is a period of the unit pulse sequences, where n ranges from a first integer number to a second integer number, (ii) calculating $\mathrm{Sum}(n)=\Sigma_i\mathrm{Sum}_i(n)$, and (iii) determining a value of n=N resulting in a greatest $\mathrm{Sum}(n)=\Sigma_i\mathrm{Sum}_i(n)$, wherein said match is determined to exist with said one of said unit pulse sequences having a pulse period equal to N, and said rhythmic beat is determined to correspond to period N.

5. A method according to claim 4, further comprising a check frame decision step (g) comprising:

(i) with respect to a second frame of said plurality of successive frames which immediately succeeds said first one of said frames, performing a check frame decision processing by calculating a function $\mathrm{Sum}_i(n)=x(M)+x(M+n)+x(M+2n)+\ldots+x(M-n)+x(M-2n)$, where, for said second frame, x is a signal representing the onset peak train, i is a selected peak point index, M is a peak point position, and n is a period of the unit pulse sequences, where n ranges from n=N−L to n=N+L, where L is an integer which is less than a difference between said first and second integers, calculating $\mathrm{Sum}(n)=\Sigma_i\mathrm{Sum}_i(n)$ and determining whether N yields a peak in Sum(n) for said check frame processing of said second frame;

(ii) if step (g)(i) determines that N yields said peak in Sum(n) for said check frame processing of said second frame, said rhythmic beat for said first frame and for said second frame is determined to correspond to period N and a third frame immediately succeeding said second frame is processed in accordance with step (g)(i); and (iii) if step (g)(i) determines that N does not yield said peak in Sum(n), said rhythmic beat for said second frame is determined to correspond to period N and a third frame immediately succeeding said second frame is processed in accordance with step (f).

6. An apparatus for determining a rhythmic beat of a digital sound signal, said apparatus comprising:

(a) decimation means for down sampling the digital signal by a predetermined factor to produce a decimated signal comprising a plurality of first data points;

(b) group summation means for grouping said plurality of first data points into groups each comprising a predetermined number of said first data points of said decimated signal and summing absolute values of said data points in each of said groups to produce a group-summed signal comprising a plurality of second data points;

(c) means for dividing said plurality of second data points of said onset peak train into a plurality of successive frames of uniform duration;

(d) determination means for determining for each of said frames a threshold value and for detecting, within each of said frames, peak profiles each comprising successive ones of said second data points having values greater than said threshold value;

(e) detection means for detecting, within each of said peak profiles, a peak point having a greatest value among said successive ones of said second data points; and (f) match detection means for determining a match between (i) said peak point and ones of said second data points located at least one of before and after said peak point and (ii) one of a plurality of unit data pulse sequences, having different periods, in accordance with an algorithm, wherein said rhythmic beat is determined to correspond to the period of said one of said unit pulse sequences, wherein said threshold value is defined by a relation (A+M')/2, where A is the average of the values of all of said second data points within one of said frames and M' is the maximum of the values of all of said second data points within said one of said frames.

7. An apparatus according to claim 6, further comprising means for processing said second data points in accordance with a smooth-and-differentiate algorithm prior to said second data points being divided into said frames.

8. An apparatus according to claim 6, wherein said means for processing in accordance with said smooth-and-differentiate algorithm comprises a rectification step including setting to zero all of said second data points having values less than zero.

9. An apparatus according to claim 6, wherein said match detection means comprises means for performing a full processing operation comprising calculating a function $$\mathrm{Sum}_i(n)=x(M)+x(M+n)+x(M+2n)+\ldots+x(M-n)+x(M-2n)$$

where, for said first one of said frames, x is a signal representing the onset peak train, i is a selected peak point index, M is a peak point position, and n is a period of the unit pulse sequences, where n ranges from a first integer number to a second integer number, (ii) calculating $\mathrm{Sum}(n)=\Sigma_i\mathrm{Sum}_i(n)$, and (iii) determining a value of n=N resulting in a greatest $\mathrm{Sum}(n)=\Sigma_i\mathrm{Sum}_i(n)$, wherein said match is determined to exist with said one of said unit pulse sequences having a pulse period equal to N, and said rhythmic beat is determined to correspond to period N.

10. An apparatus according to claim 9, further comprising (g) a check frame decision means for:

(i) with respect to a second frame of said plurality of successive frames which immediately succeeds said first one of said frames, performing a check frame decision processing by calculating a function $\mathrm{Sum}_i(n)=x(M)+x(M+n)+x(M+2n)+\ldots+x(M-n)+x(M-2n)$, where, for said second frame, x is a signal representing the onset peak train, i is a selected peak point index, M is a peak point position, and n is a period of the unit pulse sequences, where n ranges from n=N−L to n=N+L, where L is an integer which is less than a difference between said first and second integers, calculating $\mathrm{Sum}(n)=\Sigma_i\mathrm{Sum}_i(n)$ and determining whether N yields a peak in Sum(n) for said check frame processing of said second frame;

(ii) if operation (g)(i) determines that N yields said peak in Sum(n) for said check frame processing of said second frame, said rhythmic beat for said first frame and for said second frame is determined to correspond to period N and a third frame immediately succeeding said second frame is processed in accordance with operation (g)(i), and (iii) if operation (g)(i) determines that N does not yield said peak in Sum(n), said rhythmic beat for said one of said second frame is determined to correspond to period N and said third frame is processed in accordance with said full processing operation.

* * * * *